US005103532A

United States Patent [19]

Youngdale et al.

[11] Patent Number: 5,103,532

[45] Date of Patent: Apr. 14, 1992

[54] FLAT-MOUNTED CABINET DOOR HINGE HAVING LOW PROFILE

[76] Inventors: Louis L. Youngdale, 802 Crescent Dr.; Robert L. Youngdale, 2548 Foothill Dr., both of Vista, Calif. 92084

[21] Appl. No.: 475,946

[22] Filed: Feb. 6, 1990

Related U.S. Application Data

[63] Continuation-in-part of Ser. No. 290,292, Dec. 27, 1988, abandoned.

[51] Int. Cl.[5] ..... E05F 1/08

[52] U.S. Cl. ..... 16/288; 16/370

[58] Field of Search ..... 16/288, 370

[56] References Cited

U.S. PATENT DOCUMENTS

| | | | |
|---|---|---|---|
| 1,118,938 | 12/1914 | Laurich . | |
| 3,038,196 | 6/1962 | Nyquist . | |
| 3,066,349 | 12/1962 | Youngdale . | |
| 3,316,496 | 5/1983 | Hetal-Werke Hettich . | |
| 3,626,548 | 12/1971 | Grunert . | |
| 3,673,635 | 7/1972 | Cencioni . | |
| 3,952,368 | 4/1976 | Zernig et al. . | |
| 4,736,491 | 4/1988 | Mertes . | |
| 4,827,569 | 5/1989 | Mertes | 16/288 |

FOREIGN PATENT DOCUMENTS

| | | | |
|---|---|---|---|
| 4023 | 9/1979 | European Pat. Off. | 16/288 |
| 3316496 | 2/1985 | Fed. Rep. of Germany . | |
| 3544488 | 6/1987 | Fed. Rep. of Germany . | |

*Primary Examiner*—Robert L. Spruill
*Assistant Examiner*—Carmine Cuda
*Attorney, Agent, or Firm*—John J. Murphey

[57] ABSTRACT

A flat-mounted cabinet door hinge, having a low cabinet-side profile, including a cabinet mounting plate and a door mounting plate interconnected by an elongated carrier plate, optionally containing a bend, attached to the cabinet and door mounting plates through a link and a toggle, to allow the door to swing from a closed position through an arc exceeding 90° to an open position and containing a spring device to urge and releasably hold the door in its closed position against the cabinet.

11 Claims, 4 Drawing Sheets

FLAT-MOUNTED CABINET DOOR HINGE HAVING LOW PROFILE

RELATION TO OTHER APPLICATIONS

This application is a continuation-in-part of my previous application filed Dec. 27, 1988, and given Ser. No. 07/290,292, now abandoned.

BACKGROUND OF THE INVENTION

1. Field of the Invention

This invention relates to cabinetry hardware. More specifically, it relates to cabinet hinges of the specific type that may be flat-mounted against the cabinet side wall and cabinet door without need to cut depressions therein and that develops a low profile at the side of the cabinet to allow close fitting of slide rails against the cabinet side walls.

2. Description of the Prior Art

Modern designs for office interiors, laboratories, kitchens, and living quarters often call for very sober and flat structure devoid of any protrusions or dust-gathering ridges and ornamentations. Cabinet doors are often mounted in an overlaid configuration with nearly abutting edges. Conventional hinges, handles and latch mechanisms which would disturb the purity and sobriety of the design are no longer in vogue and efforts have been made to limit, conceal and avoid them altogether.

Many cabinets are designed to hold drawers and shelves mounted on slides or runners attached to the insides of the cabinets It is necessary that the cabinet door hinges develop a low silhouette to allow the drawer or shelf to be pulled out on its slides without bumping into the hinge mechanism. Presently, no such hinge is available, i.e. that has a low silhouette in combination with the other desirable traits, and the drawer runners must be shimmied away from the cabinet side wall to allow the drawer to be withdrawn past the bulky hinge mechanism. This narrows the drawer, requires substantial carpentry time to shim the runners, and reduces the amount of contents that can be stored on the narrow shelf.

The prior art has often required the carpenter to cut deep holes or depressions in either the cabinet side wall or the cabinet door or both in which to mount the hinge mechanism to keep it out of interference with the drawer or shelf that is to be pulled from the cabinet after the door is opened. This cutting and drilling require substantial expertise on the part of the carpenter. Cutting or drilling into the door or cabinet side wall also raises the potential for slippage, misalignment or breaking through the door surface and thus raises the potential for doors and cabinet sides to be rendered useless because of improper mounting techniques. In cabinets using glass doors or other materials not easily capable of such drilling, such hinges are not unable at all. In addition, the skill of the carpenter in mounting such complicated devices raises the installation cost and total price to be paid by the user.

In addition, often it is desired that cabinet doors be hinged to open beyond a 90°-angle to allow better access to the contents therein. This is in conjunction with the added desire that, upon the door being opened, no arm, hook, tab, tongue or other part of the hinge mechanism remain projected inward toward the cabinet interior that would pose a hazard to those reaching into the cabinet.

Still further, it is often desired to have a hinge that has the function of applying a positive cabinet door-closing pressure against the cabinet to prevent accidental bumping, vibration, earthquakes or other disturbances from allowing the doors to open and let the contents spill out and fall to the floor. Additionally, it is desired the hinge operate silently so as not to squeak or rattle and disturb persons nearby.

None of these desires are handled by any one hinge on the market today. Accordingly, there remains a significant area of needed improvement in the field of cabinetry, namely for the design of a positive door-closing hinge that may be flat-mounted to the cabinet and door, i.e., without the requirement of cutting or drilling grooves or depression in either the cabinet or the door, and that shows or displays a low profile when the hinge is fully opened to allow withdrawal of the drawer or shelf from inside the cabinet outward without interference with the hinge mechanism.

SUMMARY OF THE INVENTION

This invention solves all of the aforesaid problems. It is a flat-mounted cabinet door hinge having positive door-closing qualities. It develops a low cabinet-side profile when opened thereby allowing the drawer to be mounted closer to the side wall, and often without shims, and withdrawn without interference with the hinge. Further, the hinge is mountable by the simple steps of placing it against the door and cabinet side wall and fastening with ordinary means such as screws or nails against the respective surfaces without the need for any drilling or gouging of depressions in which to put any portion of the hinge. Finally, it is quiet in operation and adjustable over a wide variety of applications thereby permitting its use throughout the cabinetry industry.

The main object of this invention is a cabinet door hinge for flat-mounting against the interior of a cabinet and cabinet door having a low cabinet-side silhouette when the hinge is fully opened. Other objects include a hinge that is capable of being mounted in a cabinet without the requirement of drilling, cutting, gouging or otherwise forming a depression in either the cabinet side wall or the cabinet door; a hinge that develops a low profile to allow passage of a drawer or shelf that is supported along the cabinet sides by runners or slides; a hinge that may be installed and easily mounted by semi-skilled personnel; a hinge that permits the door to be opened beyond 90°; and, a hinge that is fully concealed within the cabinet including the cabinet door edge and, when opened, be free of arms, hooks, tabs, tongues or other parts that project inward toward the cabinet interior to pose a hazard to those reaching into the cabinet.

These and other objects of the invention will more clearly appear upon reading the following description of the preferred embodiment together with the drawings appended hereto. The scope of protection sought by the inventor may be gleaned from a fair reading of the claims that conclude this specification.

DESCRIPTION OF THE PREFERRED EMBODIMENT

Figure 1:
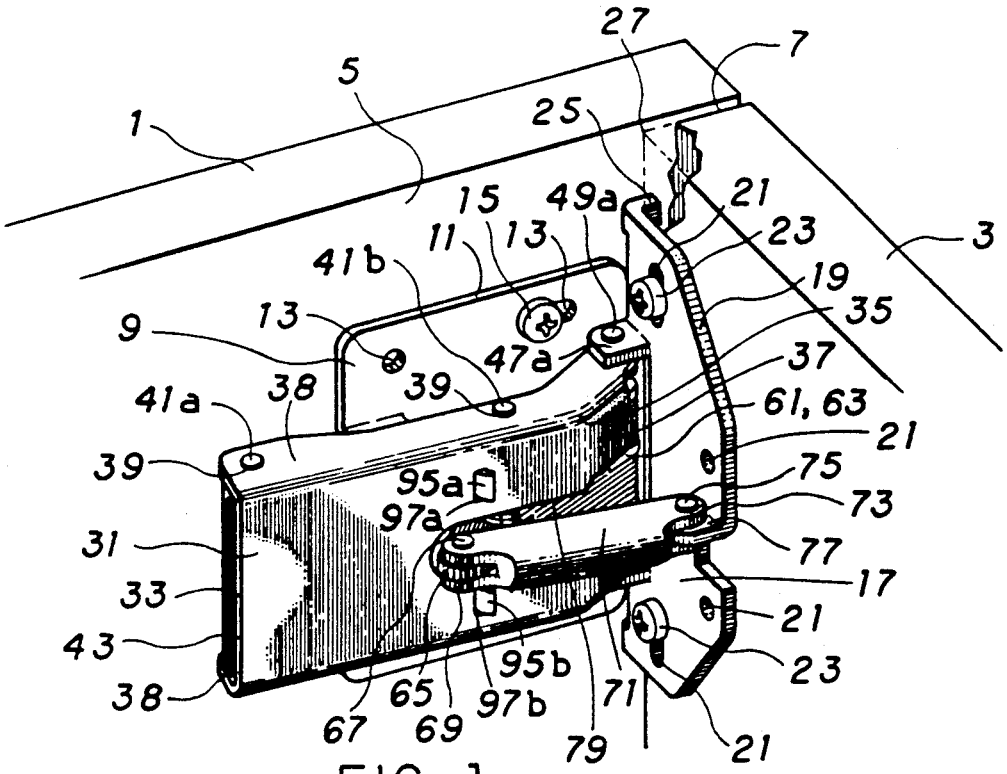
FIG. 1 is a perspective view of the preferred embodiment of this invention shown mounted against a cabinet door and cabinet side wall, with the door in the closed position.

Turning now to the drawings, wherein like elements are identified with like numerals throughout the eight figures, FIG. 1 shows the hinge of this invention mounted between a cabinet door 1 and a cabinet side wall 3, said door 1 being such that its inside surface 5 is spaced apart from cabinet side wall end or jamb 7. This embodiment of the hinge comprises a door mounting plate 9 defined by a perimeter 11 and having a series of apertures 13, in the form of holes and/or slots, formed therethrough through which fastener means such as a screw 15 or nails (not shown) may pass into door 1 to affix plate 9 thereto.

Figure 4:
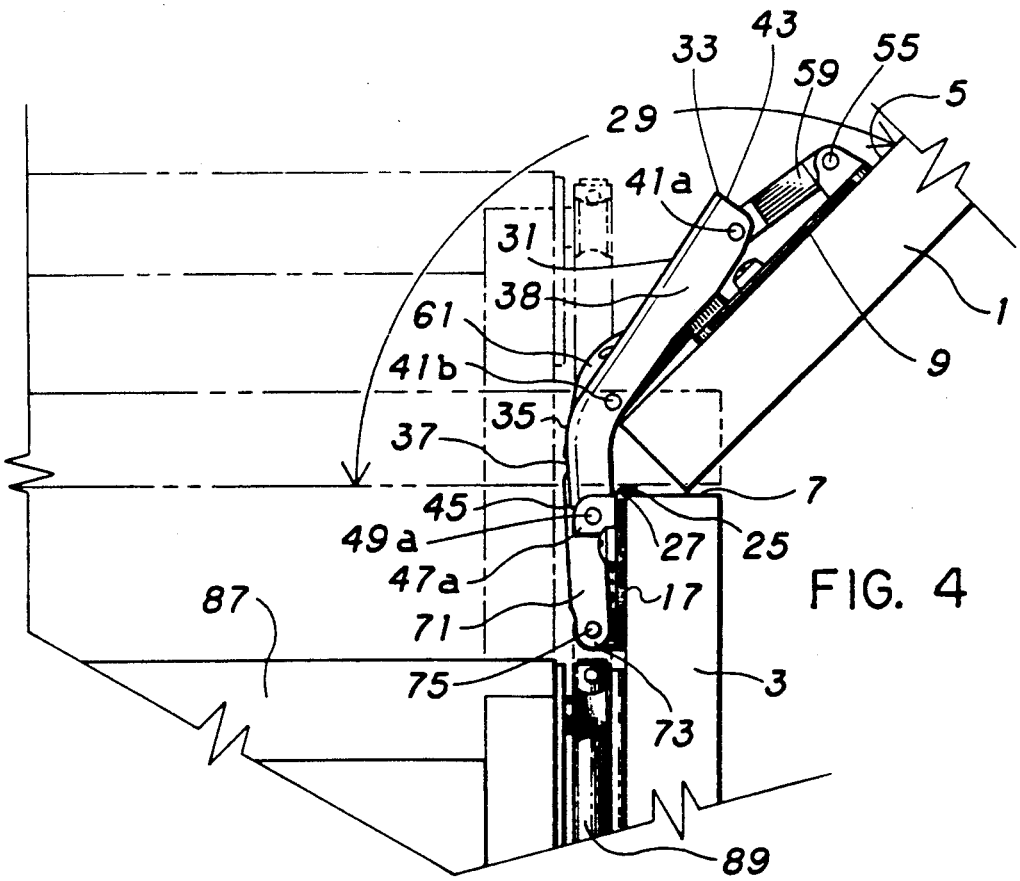
FIG. 4 is a top-plan view of the cabinet door in its fully opened position showing, for illustrative purposes, a drawer mounted on a runner that may pass by the hinge shown in FIG. 1 without interference.
Figure 5:
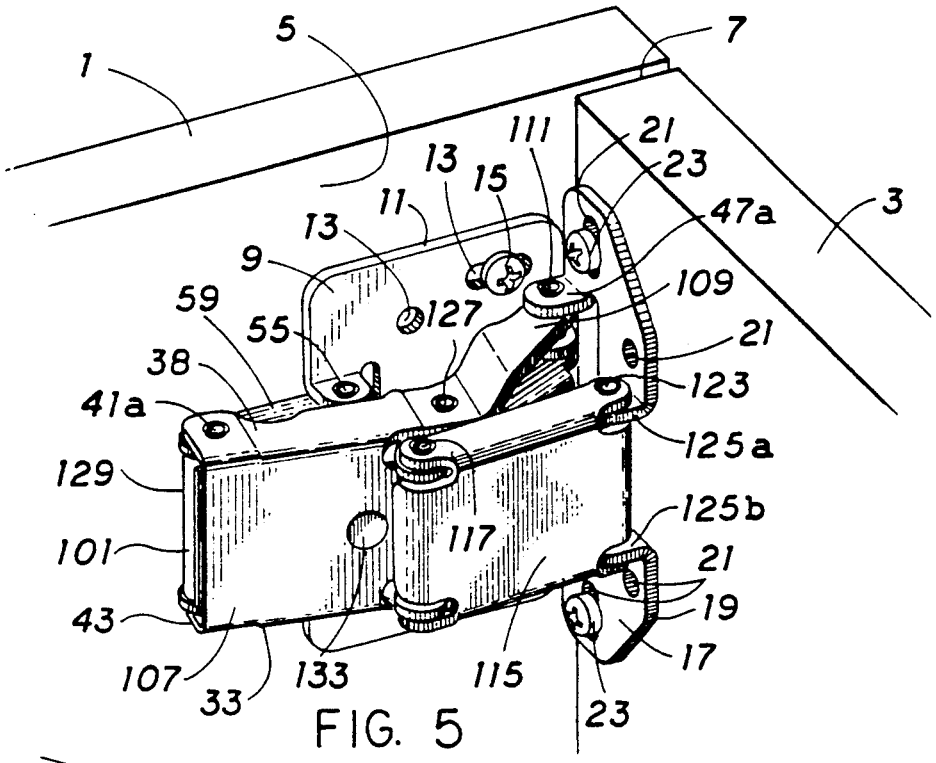
FIG. 5 is a perspective view of a second embodiment of this invention shown mounted against a cabinet door and cabinet sidewall, with the door in the closed position.

Also provided is a cabinet mounting plate 17 defined by a perimeter 19 that has formed therethrough a series of apertures 21, such as holes and/or slots, through which fastener means such as screws 23 may pass into cabinet side wall 3 to affix plate 17 thereto. For aid in aligning plate 17, one or more tabs or ears 25 may be formed and turned up out of the plane of plate 17 for positioning against the interior corner 27 of jamb 7. As seen in FIG. 4, door mounting plate 9 and cabinet mounting plate 17 are positioned such as to allow cabinet door to swing between a closed position, shown in FIG. 1, through an arc 29 to an open position beyond 90° of door opening to an angle that may vary from 110° to 150° but more desirably about 135°.

As is shown in all the figures, an elongated carrier plate 31, defined by a perimeter 33, is provided containing a bend 35 making an offset 37 so that plate 31 takes on a bent appearance. A pair of spaced-apart side walls 38 integral with plate 31 and offset 37, extend outward from perimeter 33 and contain a series of pairs of spaced-apart apertures 39 wherein are respectively received hinge pins 41*a* and 41*b* transversely across plate 31 whose operation will hereinafter be more fully explained. Carrier plate 31 is further defined by a pair of spaced-apart terminal edges 43 and 45.

A pair of upturned ears 47*a* and 47*b* are formed on cabinet mounting plate 17, normal to the plane of plate 17, in spaced apart relation and pivotally received therebetween carrier plate side walls 38. Each of ears 47*a* and 47*b* and the adjacent portions of carrier plate side walls 38 contain apertures through which short hinge pins 49*a* and 49*b* are received to hingedly attach carrier plate end 45 to cabinet mounting plate 17. Carrier plate 31 is adapted to hold cabinet mounting plate 17 and door mounting plate 9 in controlled alignment throughout movement of the hinge and move between a first position flush against cabinet door mounting plate 17 and a second position between both mounting plates 9 and 17 and below the height of ears 47*a* and 47*b* when the hinge is swung through its entire arc to its fully-opened position.

Two pairs of mutually spaced-apart, upturned ears 51 and 53 are formed in door mounting plate 9 through which apertures (not shown) are formed. Hinge pins 55 and 57 are inserted respectively between ears 51 and 53. A link 59 is pivotally connected between hinge pin 55 and hinge pin 41*a* to connect carrier plate terminal edge 43 to door mounting plate 9.

Figure 2:
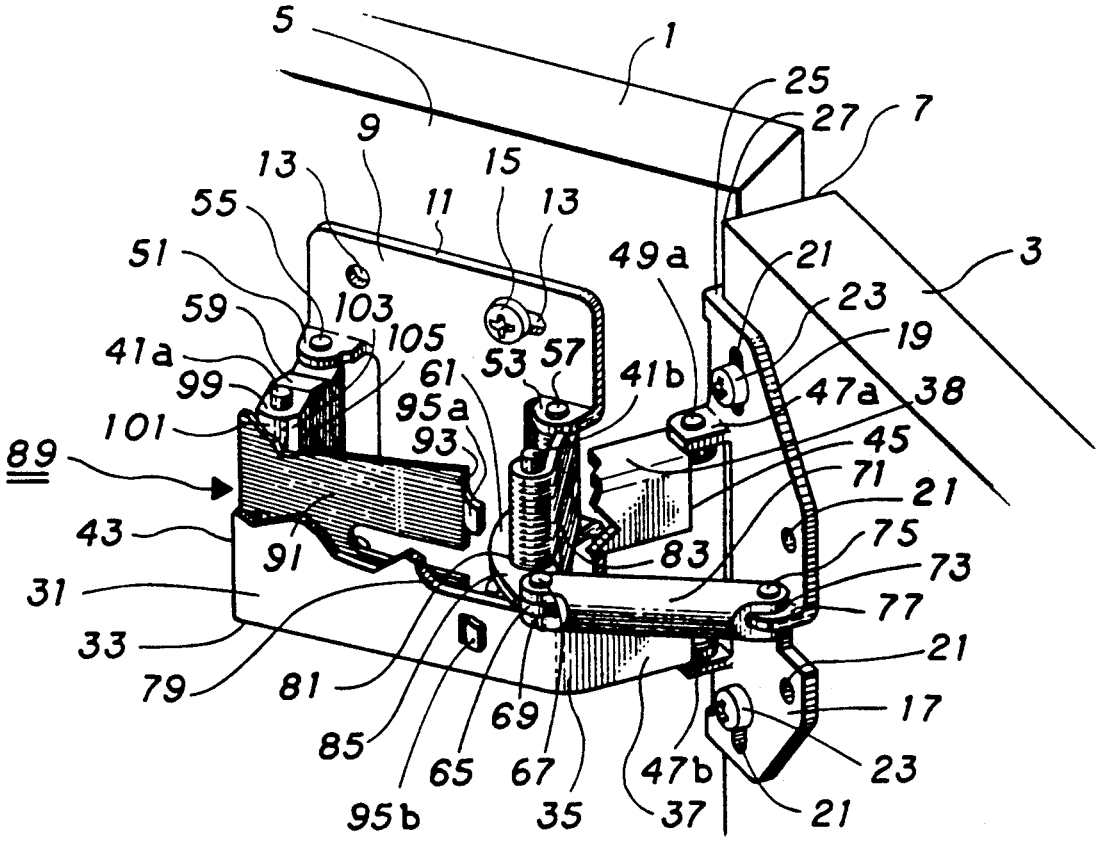
FIG. 2 is a perspective view of the embodiment shown in FIG. 1 with the door partially opened and includes a cut-away portion to show the interior of the hinge.

A connecting arm 61 of terminal length is pivotally mounted at end 63 centrally between ears 53 by hinge pin 57. The other end 65 of connecting arm 61 is pivotally mounted by a hinge pin 67 to one end 69 of a toggle 71 whose other end 73 is likewise pivotally mounted by a hinge pin 75 to an upstanding ear 77 formed on cabinet mounting plate 17. Connecting arm 61 passes through an aperture or slot 79 formed in plate 31, bend 35 and offset 37 and is further hingedly mounted near its middle portion 81 by hinge pin 41*b* passing through side walls 38 as shown in FIG. 2. Connecting arm 61 contains wide, flat portion 83 through which hinge pin 57 passes to provide stability to the hinge and resistance to twisting during opening and closing. An elongated vertical flange or backbone 85, preferably normal to flat portion 83, is likewise provided along arm 61 to resist over-opening of the hinge.

Figure 3:
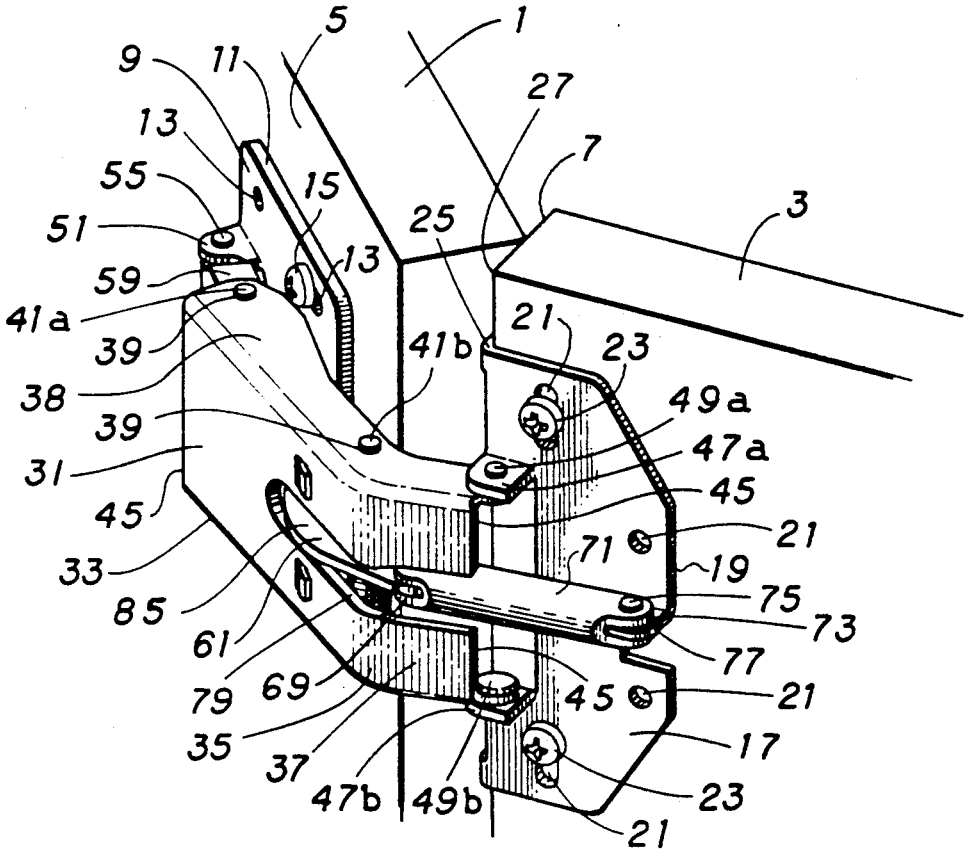
FIG. 3 is a perspective view, rotated 20° to left for clarity, of the embodiment shown in FIGS. 1 and 2 with the door in its full open position.

In this configuration, carrier plate 31 and its offset 37 move between a first position shown in FIG. 1, flush against door mounting plate 9, through a middle position (shown in FIG. 2) to an open or second position shown in FIG. 3 wherein it lies between plate 9 and plate 17 and flush against door inside surface 5 and cabinet side wall 3 when door 1 is moved through arc 29 to its outermost position as shown in FIG. 4 and below the height of upturned ears 47*a* and 47*b* to present a very low silhouette. This low overall cabinet side wall silhouette of the hinge, in both closed and opened positions, allows movement of a drawer or shelf 87, shown moving in phantom in FIG. 4, directly outward from the interior of the cabinet through the door opening without interference with the hinge. With this hinge, drawer runner 89, positioned above or below hinge, needs no longer to be shimmed away from cabinet side wall 3 but mounted directly against it.

To provide a self-closing feature to the hinge, spring means 89 is incorporated in the hinge for bias engagement with a spring follower formed integral therewith to urge and releasably hold the door in its closed position. As shown in FIG. 2, one embodiment of spring means 89 comprises a leaf spring 91 fixed at one end 93 to elongated carrier plate 31 via a pair of ears 95*a* and 95*b* formed at said end for engagement with a pair of apertures 97*a* and 97*b* formed in elongated carrier plate 31 inward from plate edge 45. Leaf spring 91 extends toward carrier plate edge 43 and passes between plate 31 and link end 99. A bend may be placed in spring 91 or in ears 95*a* and 95*b* to provide the bias pressure needed to provide door-closing pressure to the hinge. A spring follower surface 101, including a flat 103, is formed at the end or along edge 105 of link 59 adjacent its area of contact with leaf spring 91 As the hinge moves from its fully opened (second) position, leaf spring 91 rides over spring follower surface 101 and provides tightness to the hinge movement. As the hinge approaches its closed (first) position, spring 91 rides into flat 103 which causes bias pressure to be generated in spring 91 and transferred to link 59 to force the hinge into its closed position. To provide for quiet operation of the hinge, link 59 is commonly made of a strong yet slippery material having a low frictional surface. Preferred in this respect is the material Delrin (trademark).

As shown in FIGS. 5 through 8, another embodiment of the flat-mounted cabinet door hinge of this invention is shown containing the general features of the first embodiment including door mounting plate 9 with its perimeter 11 and apertures 13, for acceptance of screws 15 therethrough, and cabinet mounting plate 17 with its surrounding perimeter 19 and apertures 21 for receipt of screws 23 therethrough. In this embodiment, however, a new, shorter, preferably flat, elongated carrier plate 107 is shown, defined by perimeter 33, spaced-apart side walls 38 integral therewith, and further defined by spaced-apart terminal edges 43 and 45, that are pivotally attached to cabinet mounting plate 17 at spaced-apart ears 109 extending from side walls 38, near terminal edge 45, into pivotal contact with a pair of hinge pins 111 supported on a pair of spaced-apart, upstanding ears **47*a* and 47*b* formed on cabinet mounting plate 17**.

Carrier plate 107 is pivotally interconnected along its other terminal edge 43 to door mounting plate 9 through (first) link 59, received between spaced-apart hinge pins **41*a* and 55 similar to that shown in FIGS. 1 through 4. In this embodiment, however, carrier plate 107 contains no offset or bend, as in the previous embodiment, yet is still adapted to hold cabinet mounting plate 17 and door mounting plate 9 in controlled alignment throughout movement of the hinge and move between a first position flush against cabinet door mounting plate 17 and a second position between both mounting plates 9 and 17 and below the height of ears 47*a* and 47*b*** when the hinge is swung through its entire arc to its fully-opened position.

This is obtained by the scissor action of a second link 113 aided by a third link 115 that are pivotally interconnected at a hinge pin 117 and are in turn pivotally connected respectively to door mounting plate 9 at a hinge pin 119, that is received between a pair of upstanding, spaced-apart ears **121*a* and 121*b* (121*b* not shown), and cabinet mounting plate 17 at a hinge pin 123, that is received between a pair of upstanding, spaced-apart ears 125*a* and 125*b*. Second link 113 is pivotally interconnected with carrier plate 107 through a hinge pin 127 that is offset from hinge pin 117 so as to provide the scissor-type action with carrier plate 107 to move it from its first position, flush against door mounting plate 9, to its second position, intermediate door mounting plate 9 and cabinet mounting plate 17, when door 1 is swung open through its arc 29** to its furthest most extent, approximately 135 rotational degrees.

Figure 6:
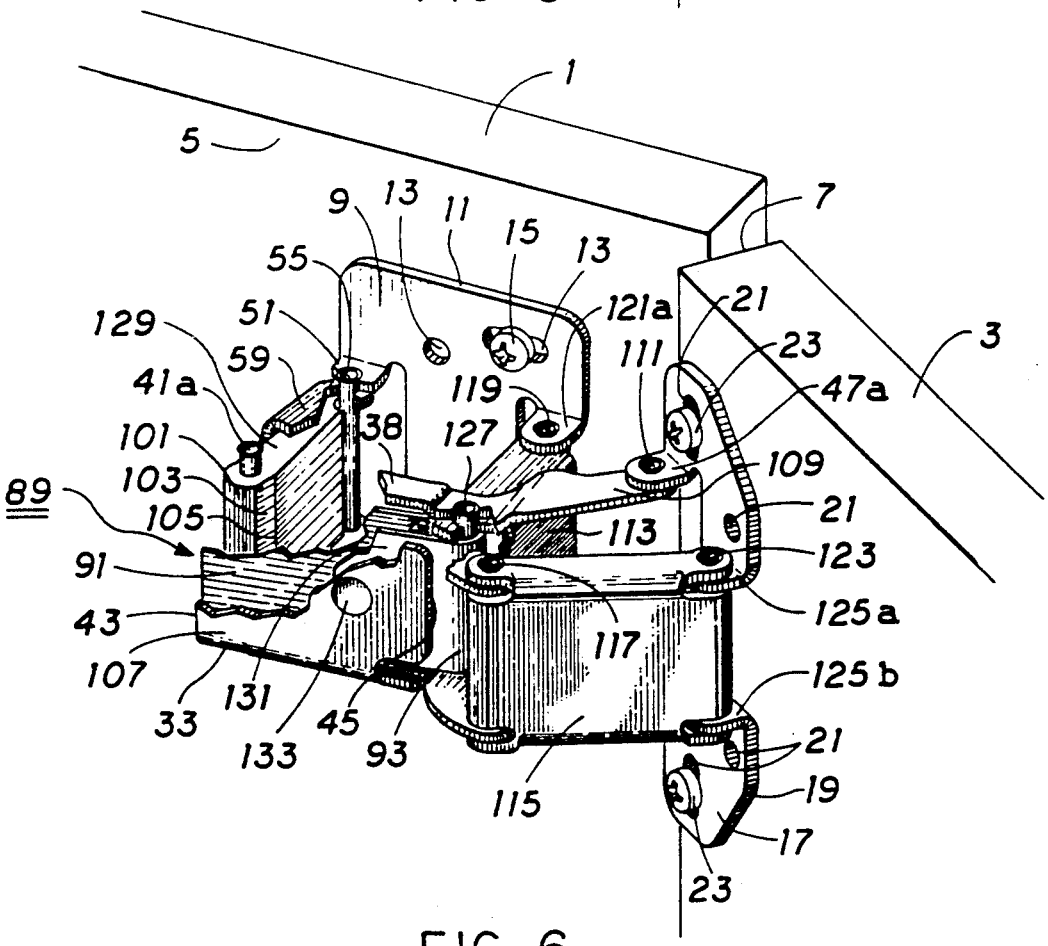
FIG. 6 is a perspective view of the embodiment shown in FIG. 5 with the door partially open and includes a cut-away portion to show the interior of the hinge.
Figure 7:
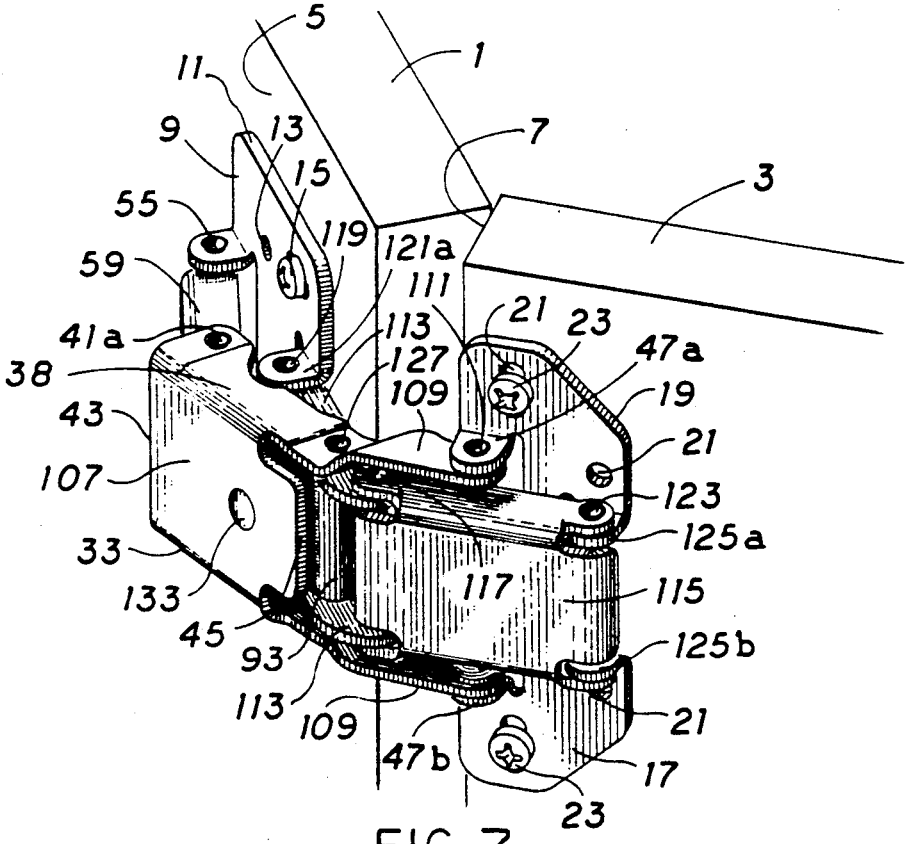
FIG. 7 is a perspective view, rotated 20° to left for clarity, of the embodiment shown in FIGS. 5 and 6 with the door in its full-open position; and, FIG. 8 is a top-plan view of the cabinet door in its fully opened position, for illustrative purposes, a drawer mounted on a runner that may pass by the hinge shown in FIG. 5 without interference.
Figure 8:
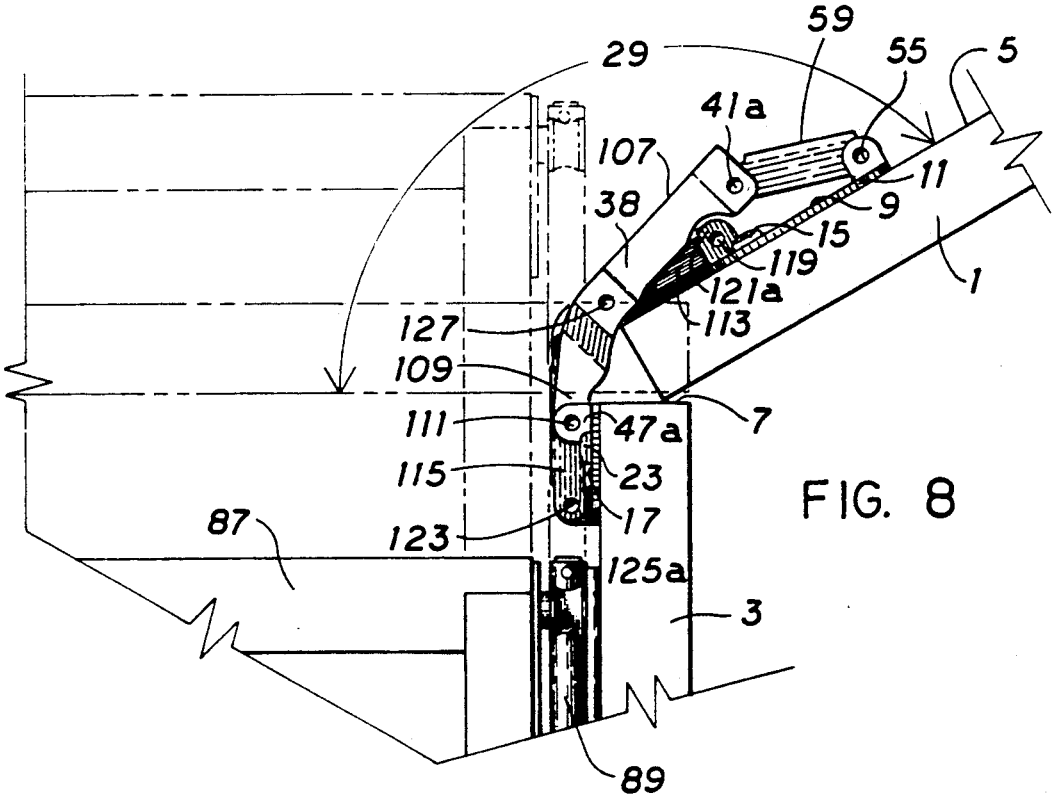

The self-closing feature of the hinge is accomplished by the same spring means 89, in FIG. 6, i.e., as that shown in FIG. 2 for the first embodiment, preferably in the form of leaf spring 91 adapted to bear against a spring follower surface 101 and including flat 103, formed at end 105 of an insert 129 and held against first link 59 along therewith at pins **41*a* and 55. However, in lieu of support ears 95*a* and 95*b* (as in FIG. 2), that hold leaf spring end 93 against the inside surface of elongated carrier plate 31, a hook 131 is formed (see FIG. 6) in spring end 93 and looped around hinge pin 127 and a dimple 133 is formed on carrier plate 107 to bias leaf spring 91 against spring follower surface 101 and flat 103 to provide the bias pressure to urge cabinet mounting plate 17** into a less-than-90° angle to hold a cabinet door, attached thereto, against the cabinet when the hinge approaches the close position.

What is claimed is:

1. A flat-mounted cabinet door hinge having a low cabinet-side profile when in fully-opened position, comprising:

a) a cabinet mounting plate for attachment flat against the inside sidewall of the cabinet and a door mounting plate for attachment flat against the inside of the cabinet door, both said plates arranged to position the door with respect to the cabinet for swinging between closed and opened positions through an arc exceeding 90°;

b) an elongated carrier plate interconnected said door mounting plate and pivotally connected to ears projecting upward from said cabinet mounting plate, said carrier plate adapted to hold said cabinet mounting plate and said door mounting plate in controlled alignment throughout movement of said hinge and move between a first position against said cabinet door mounting plate and a second position between said mounting plates and substantially at or below the heights of said upwardly-projecting ears when said hinge is moved through its entire arc to its fully opened position;

c) spring means interconnected said carrier plate and one of said mounting plates to urge and releasably hold said hinge in its closed position; and, d) a link that is pivotally connected between said elongated carrier plate and said cabinet door plate;

e) wherein said spring means includes a leaf spring fixedly mounted to said carrier plate and extending between said plate and said link for biased interaction with a spring follower surface formed on said link and a flat formed on said cam follower surface for interaction with said leaf spring, as the hinge approaches its closed position, to urge and releasably hold said hinge in its closed position.

2. A flat-mounted cabinet door hinge having a low-cabinet side profile comprising:

a) a cabinet mounting plate for attachment to the inside of the cabinet and a door mounting plate for attachment to the inside of the cabinet door, both said plates arranged to position the door with respect to the cabinet for swinging between closed and opened positions through an arc exceeding 90°;

b) an elongated carrier plate adapted to receive the ends of a plurality of hinge pins, pivotally connected to ears projecting upward from said cabinet mounting plate, transversely thereacross for hinging one end of said carrier plate to said cabinet mounting plate and hinging the other end thereof to a link that is in turn pivotally connected to said door mounting plate and containing an offset so that said carrier plate moves between a first position flush against said door mounting plate and a second position between said mounting plates and substantially at or below the height of said upwardly-projecting ears when said hinge is moved through its entire arc to its fully-opened position;

c) a connecting arm of terminal length, hingedly mounted at one end to said door mounting plate, passing through an aperture formed in said carrier plate, and pivotally connected at another end to a toggle, said toggle being in turn hinged to said cabinet mounting plate, said arm also pivotally connected to said carrier plate adjacent said aperture and adapted for pivotal motion between a position flush against said door mounting plate and flush against said cabinet mounting plate as said hinge moves between closed and open positions; and, d) spring means attached to said hinge for bias engagement with a spring follower surface formed integral therewith to urge and releasably hold said hinge in its closed position;

e) wherein said carrier plate is adapted to align said plates, link, arm and toggle for coordinated motion during movement of said hinge and to hold said link, arm and toggle down flush against said door mounting plate and said cabinet mounting plate when said hinge is moved into its opened position at the end of said arc;

f) wherein said door mounting plate has formed therein at least one aperture and one slot for receipt therethrough of fasteners to mount said plate flat against a door; and, g) further including at least one ear normal to the plane of said cabinet mounting plate for position against the cabinet sidewall to align said hinge thereto.

3. The flat-mounted cabinet door hinge of claim 2 wherein said link is made of a low-friction material.

4. The flat-mounted cabinet door hinge of claim 3 wherein said low-friction material is Delrin (trademark).

5. The flat-mounted cabinet door hinge of claim 2 wherein said spring means includes a wide-leaf spring fixedly mounted to said carrier plate and extending to the hinged connection between said carrier plate and said link for bias interaction with a spring follower surface formed on said link.

6. The flat-mounted cabinet door hinge of claim 4 wherein said link includes a flat, thin plate defined along one edge by an elongated radial surface that is placed in contact with said spring means and that further has formed therealong a flat for interaction with said spring means to provide releasable hinge closure pressure to said hinge when said hinge is moved into its closed position.

7. A flat-mounted cabinet door hinge having a low cabinet-side profile comprising:

a) a cabinet mounting plate for attachment flat against the inside sidewall of the cabinet and a door mounting pale for attachment flat against the inside of the cabinet door, both said plates arranged to position the door with respect to the cabinet for swinging between closed and opened positions through an arc exceeding 90°;

b) a carrier plate pivotally attached to said cabinet mounting plate and pivotally interconnected to said door mounting plate through a first link, and adapted for movement, between a first position flush against said cabinet door mounting pate and a second position between and flush against said plates when said hinge is moved through its entire arc to its fully-opened position; and, c) spring means interconnected said carrier plate and one of said mounting plates to urge and releasably hold said hinge in its closed position wherein said spring means includes a leaf spring fixedly mounted to said carrier plate and extending between said plate and said first link for biased interaction with a spring follower surface formed on said first link and a flat formed on said cam follower surface for interaction with said leaf spring, as said hinge approaches its closed position, to urge and releasably hold said hinge in its closed position.

8. The flat-mounted cabinet door hinge of claim 7 wherein said first link is made of a low-friction material.

9. The flat-mounted cabinet door hinge of claim 8 wherein said low-friction material is Delrin (trademark).

10. The flat-mounted cabinet door hinge of claim 7 wherein said first link is a flat, thin plate defined along one edge by an elongated radial surface that is placed in contact with said spring means and that further includes a flat formed therealong for interaction with said spring bias means to provide releasable hinge closure pressure to said hinge when said hinge is moved into its closed position.

11. The flat-mounted cabinet door hinge of claim 7 wherein said spring means includes a wide-leaf spring fixedly mounted to said carrier plate and extending to said hinged connected between said carrier plate and said first link for biased interaction with a spring follower surface formed on said link.

* * * * *